United States Patent [19]

Billman et al.

[11] Patent Number: 4,756,694

[45] Date of Patent: Jul. 12, 1988

[54] DUAL ROW CONNECTOR FOR LOW PROFILE PACKAGE

[75] Inventors: Timothy B. Billman, King; Roger L. Thrush, Clemmons; Donald J. Zutaut, Winston-Salem, all of N.C.

[73] Assignee: AMP Incorporated, Harrisburg, Pa.

[21] Appl. No.: 944,400

[22] Filed: Dec. 19, 1986

[51] Int. Cl.[4] ..... H01R 23/70

[52] U.S. Cl. ..... 439/61; 439/328

[58] Field of Search ..... 339/17 L, 17 LM, 17 M, 339/65, 75 MP, 176 MP, 198 G, 276 SF; 361/413, 415; 439/59-62, 325-328, 630, 631

[56] References Cited

U.S. PATENT DOCUMENTS

| | | | |
|---|---|---|---|
| 2,904,768 | 9/1959 | Rasmussen | 339/17 LM |
| 2,931,006 | 3/1960 | Klumpp, Jr. | 339/59 M |
| 3,082,397 | 3/1963 | Clarkson et al. | 339/59 M |
| 3,567,998 | 3/1971 | Ammerman | 339/176 MP |
| 3,601,775 | 8/1971 | Longenecker et al. | 339/176 |
| 3,753,211 | 8/1973 | Pauza et al. | 339/75 MP |
| 4,077,694 | 3/1978 | Cobaugh et al. | 339/176 MP |
| 4,473,263 | 9/1984 | Sunstein | 361/415 |
| 4,575,172 | 3/1986 | Walse et al. | 339/75 MP |
| 4,577,922 | 3/1986 | Stipanuk et al. | 339/176 MP |

FOREIGN PATENT DOCUMENTS 2162380 1/1986 United Kingdom .

OTHER PUBLICATIONS

"Edge Connectors", Molex Catalog, pp. 1F-5F, published 9-1985.

*Primary Examiner*—Neil Abrams
*Attorney, Agent, or Firm*—Eric J. Groen

[57] ABSTRACT

A connector housing included multiple rows of contacts with the housing molded to provide an orientation to receive printed circuit board modules inserted therein at an angle of substantially less than 90 degrees relative to a common printed circuit board module mounting board. The rows of the housings have at each end board guide and support slots containing latches integrally therewith and a central structural web connecting said rows and guide ends, the such web providing structural support of said rows and at the same time, serving as a path of flow during the connector molding process.

18 Claims, 6 Drawing Sheets

Fig. 2A
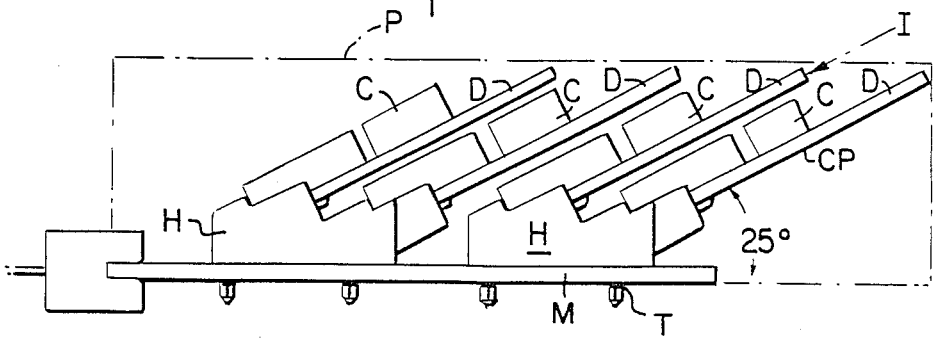
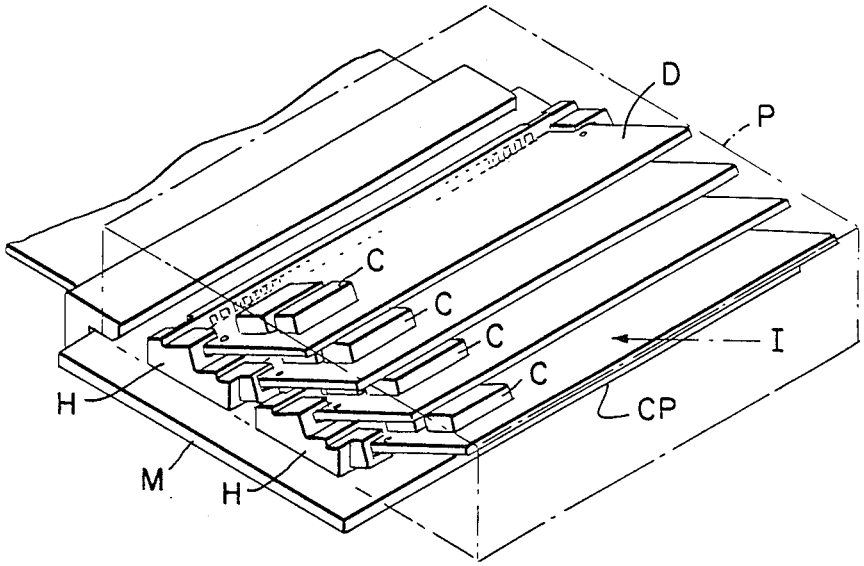
Fig. 2B

DUAL ROW CONNECTOR FOR LOW PROFILE PACKAGE

The present invention relates to a dual row printed circuit board connector which receives and supports printed circuit board modules known as daughter boards and effects an interconnection thereof to a further common printed circuit board known as a mother board, with an axis of mounting relative thereto which is substantially less than the traditional 90 degrees, to thereby provide an electronic package of lower profile. The connector housing is molded in a fashion to provide a structural integrity necessitated by the need to support the weight of daughter boards and the components thereon.

BACKGROUND OF THE INVENTION

Edge connectors for printed circuit boards are well known and widely used as the principle means of interconnecting electronic subassemblies which form functioning devices such as computers, telecommunications gear, test apparatus and the like. Such connectors are often termed 'PC board connectors' or edge card connectors and are typically comprised of plastic material formed into what is known as a housing and made to contain a series of electrical contacts stamped and formed and plated to interconnect the individual components on a daughter board through pads on the edge thereof to circuits in or on a mother board via tabs or posts soldered thereto. The contacts of the connector generally are arranged to have spring portions which allow the daughter boards to be plugged in or removed therefrom. This arrangement permits replacement, repair or changes in components on the daughter boards to be done apart from the location of the mother board. It further allows the different circuits and arrangements of components to be individually packaged so as to be separately processible in production.

The concept of the use of printed circuit boards to mount components as on daughter boards and to be pluggably interconnected as on mother boards has indeed become one of the major means of providing electronic circuits of all kinds, and the connectors used therefor are widely employed in industry. U.S. Pat. No. 4,077,694 shows an example of an edge card connector which has two rows of terminals which contact both sides of a daughter board, and U.S. Pat. No. 3,601,775 shows a similar arrangement for contact of one side of a board.

In general, the printed circuit board connector serves a first function of allowing the mounting of contacts on appropriate centers in an appropriate orientation to make contact with pads on daughter boards on the one hand, and contact with pads or holes in a mother board interconnected to circuits thereon. A second function performed by the connector is to physically mount the daughter board in a stable and reliable manner so that it will not be unintentionally displaced or disturbed in use. It is particularly critical that the daughter board not be allowed to move through vibration or other physical stimuli relative to the electrical interface with the connector contact, as this can cause circuit intermittence as well as a deterioration of the contact interfaces due to fretting corrosion or the like. The connector housing which is typically of a dielectric material suitably moldable, contains card or board guides so as to accurately position a daughter board relative to a mother board so that all interconnections are maintained properly in both a physical and dimensional sense and in terms of suitable electrical isolation.

As a general rule, card guides or other such structures are employed to help align daughter boards during insertion into printed circuit board connectors and more importantly, to support such boards so that the weight thereof will not overly stress the contacts contained in such connectors or the housings of the connectors, particularly with respect to the weight of the components mounted on daughter boards. This weight is not always static in that electronic packages are frequently subjected to movement in a variety of attitudes, vibration, shock as by dropping, or sudden changes in velocity or acceleration; all expressed in at least some part in a variety of compressional, sheer and tensional forces on the connector housing, as well as on the contacts therein.

The advance of semiconductor technology has resulted in development of chip carriers which comprise substrates on which the chips are mounted and electrically connected by fine wires. The substrates are plugged into sockets having resilient contact members which make contact with surface traces on the substrate. See, e.g., U.S. Pat. No. 3,753,211, which discloses a socket having terminals for contact with opposed edges. In some applications, as where as board space is at a premium, it is desirable to connect the substrate edge to the board. One such application is the use of edge mounted memory modules in the form of single in-line memory modules. Standard card edge connectors cannot be simply downsized to meet the requirements of a substrate to board connection, known as a level two connection. This connection is relatively much smaller and requires simple, compact contacts on a much smaller spacing. As such, variations in board thickness and board warpage are much more likely to deflect contact means beyond the elastic limit, which would adversely affect contact pressure and thus the integrity of the electrical connection of future substrate insertions.

Given that the single in-line memory modules have a tendency for the boards to warp, the housing which carries the electrical contacts must be designed to optimally resist the warpage of the housing also. Furthermore with the anticipated vibration of the connectors and modules, it is important that the connector to include a latching means to detect the full insertion of the module into the socket and to prevent the withdrawal of the module during vibration. Further considerations to the design of the connector relate to the attempt to increasing requirement of optimizing the real estate usage of the board while maintaining a small envelope and low profile in which the assembly resides.

SUMMARY OF THE INVENTION

The present invention relates to a printed circuit board connector which electrically interconnects the circuits on printed circuit board modules or single in-line memory modules to circuits on a common board, wherein the axis of memory module insertion and withdrawal is oblique to the plane of the common board. In an illustrative embodiment, the angle between the plane of insertion and withdrawal and the plane of the common board, is on the order of 25 degrees. This allows a lower profile package than is possible with the typical 90 degree arrangement between the plane of insertion withdrawl of a memory module and the plane of the common board. The connector housing which is of a dielectric and insulating material, includes multiple rows of contacts contained within housing portions which form slots for card support and integrally therewith, board support and latching structures on each end of such rows with the rows and the end portions interconnected by a common web of plastic material. The web which joins the rows and end portions is essentially free of surfaces which would obstruct the flow of plastic during molding of the connector and provides a one-piece integral connector structure which is rigid and sufficiently strong to accommodate the concept of having daughter boards inserted at an angle to a mother board. The central web further allows a flow of plastic during molding which has been discovered to avoid knit lines in the plastic resulting from circuitous flow paths in the mold for the connector. The web thus acts as a large and relatively broad sprue-like medium which becomes a structural part of the connector. The presence of the web and its relationship to the portions of the connector which form the contact rows and the end support structures, in conjunction with the choice of the molding injection port and the flow pattern of plastic, provides a housing of improved rigidity and strength.

BRIEF DESCRIPTION OF THE DRAWINGS

FIG. 2*a* is a side view of the daughter boards mounted in edge card connectors, in turn mounted on a mother board in accordance with the improvement of the invention.

FIG. 2*b* is an isometric view of the structure represented in FIG. 2*a*.

FIG. 3 is an isometric view of the dual row connector of the invention, somewhat enlarged relative to the showing in FIGS. 2*a* and 2*b*, to depict the various details of the connector housing and the arrangement of contacts therein.

DETAILED DESCRIPTION OF THE PREFERRED EMBODIMENT

FIGS. 1*a*, 1*b* and 2*a*, 2*b* are now referred to to explain the invention with an enumeration intended to relate the common elements of the prior art to those of the invention as an aid in comprehension. In these four figures, the common elements or features have common enumeration.

Figure 1A:
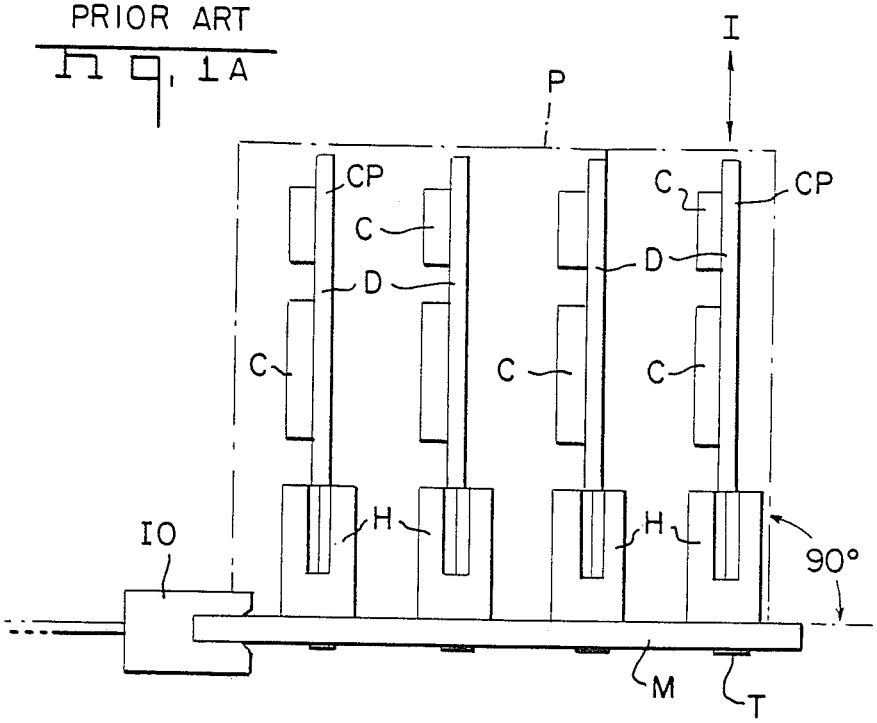
PRIOR ART FIG. 1A
FIG. 1*a* is a side view showing a series of daughter boards mounted into edge card connectors, in turn mounted on a mother board in accordance with the practice of prior art packaging.
Figure 1B:
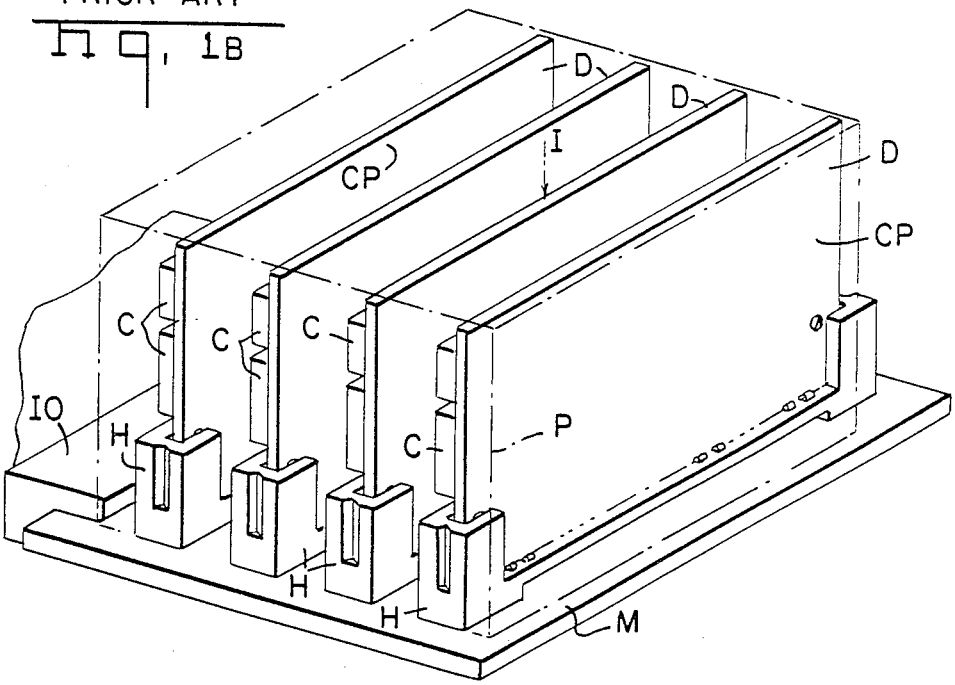
PRIOR ART FIG. 1B
FIG. 1*b* is an isometric view of the ensemble represented in FIG. 1*a*.
Figure 7:
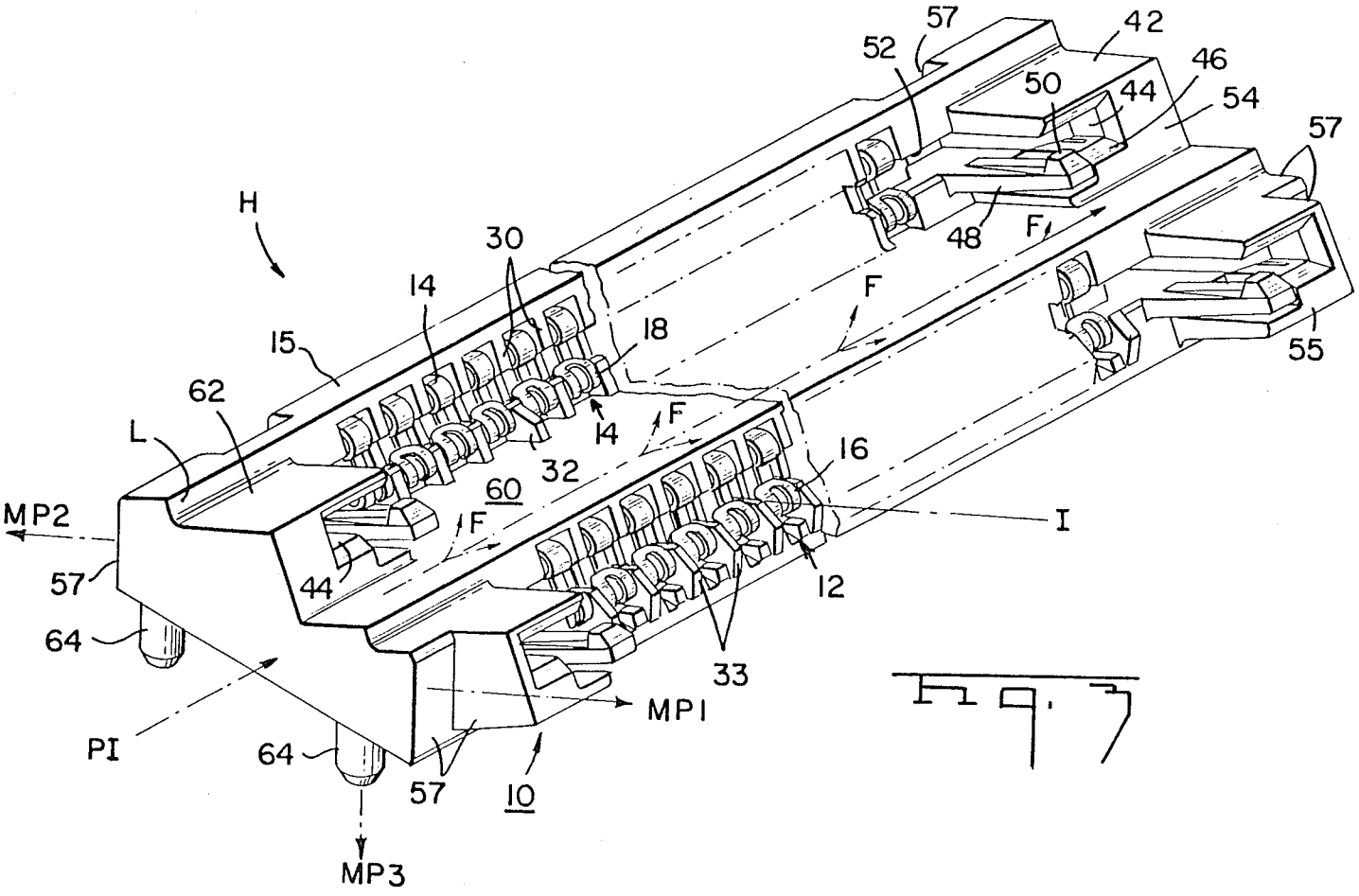

First referring to FIGS. 1*a* and 1*b*, the ensemble there shown includes a common mounting printed circuit board depicted as M which is to be understood to have a series of conductive traces thereon shown as T which form the interconnecting circuit paths relative to the electronic entity being served by the overall package, shown in phantom as P. It is to be understood that additional circuit paths such as T may be interspersed in the several layers of M or indeed carried on the top surface of M as well. Power, ground and signal paths are typically brought to M via IO connectors shown connected to one edge of M in FIGS. 1*a* and 1*b*. A series of memory modules labeled D are shown in FIGS. 1*a* and 1*b* to contain a series of electronic components C, typically integrated circuit packages and those electronic function devices which are necessary such as resistors, capacitors, inductors, diodes and the like, which form the different circuit subassemblies of the overall package. These boards or cards are plugged into edge card connectors shown as H which contain contacts similar to those to be described, in turn soldered into the mother board M. The boards D are typically inserted or withdrawn along axes shown as I in FIGS. 1*a* and 1*b*, and when inserted the boards D form an overall profile in the elevation, generally shown as P in FIG. 1*a*, and in perspective in FIG. 1*b*.

FIGS. 2*a* and 2*b* depict similar elements with similar functions to that just described, with the difference being that the housings H are dual row housings intended to take two memory modules and these housings have an axis of insertion I oblique to the plane of the mother board M. In the FIGS. 2*a* and 2*b*, this axis is shown in an illustrative manner at about 25 degrees relative to the plane of M. As can be discerned, the positioning of the memory modules D in such fashion changes the outside profile of P in a significant fashion, particularly with respect to the height thereof. If the only support given to the memory modules D was indeed that from the housings H and if the orientation of the package with respect to gravity or movement or other stresses were always as depicted in the FIGS. 1*a*–2*b*, the need for additional strength and additional support provided by the housings of the invention relative to the prior art approach would need no additional comment. It is, however, to be understood that while much of the use of the invention package is intended for computer and communication packages or perhaps in computer or appliance applications wherein the packages are always or almost always oriented as shown in the FIGS. 1*a*–2*b*, it is contemplated that other attitudes and orientations will be experienced at least in shipping or in those cases where the packaging scheme is employed in vehicles and craft which experience a wide variety of movement, acceleration, velocity, and attitude. To this end, the memory modules D may very well be associated with card guide structures not shown but which support along the edges or the rear thereof, not only with the weight of the boards but the weight of the components thereon; all tied together with the mother board which is incidentally supported by the overall package structure. Even with card guides, supports, clamps or the like, it can be discerned by comparing FIGS. 1*a*–1*b* to FIGS. 2*a*–2*b*, that their fundamental differences of structure require greater strength in the latter than in the former.

Figure 4:
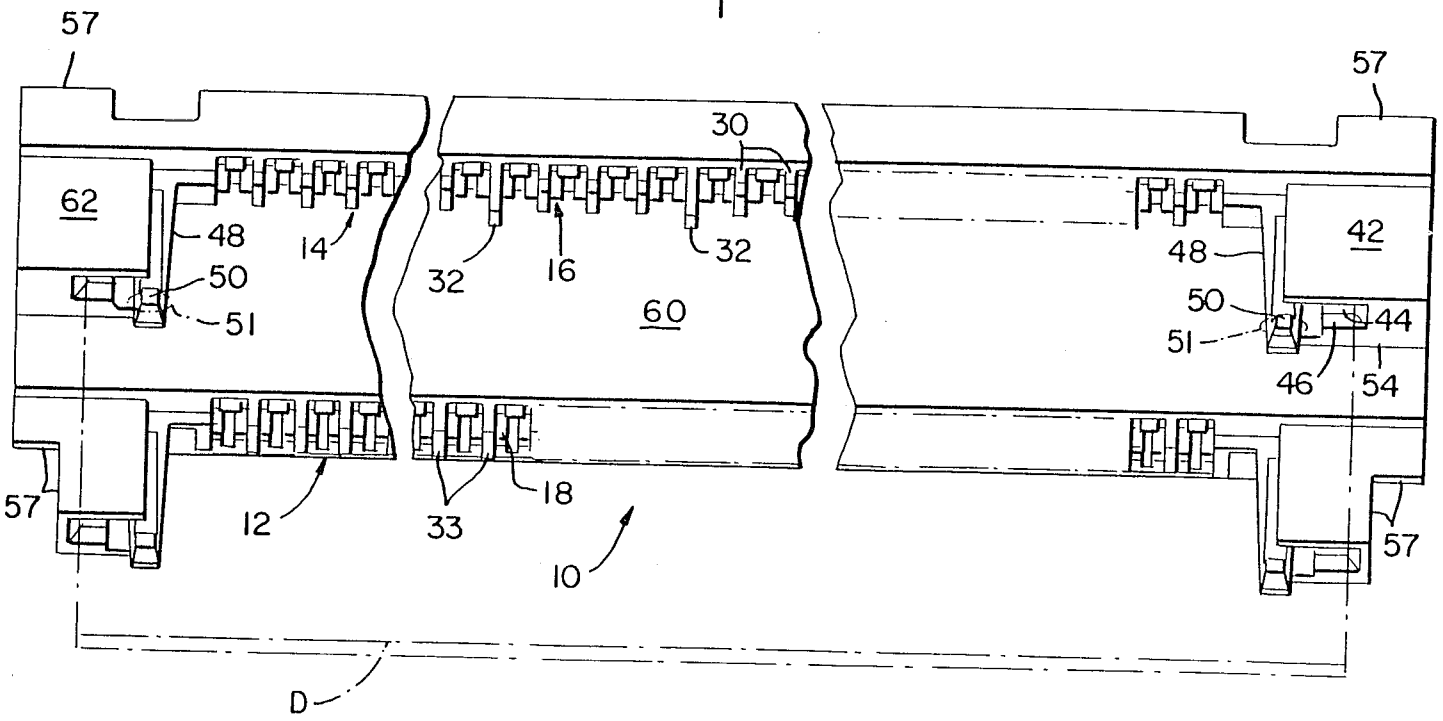
FIG. 4 is a plan view of the connector as shown in FIG. 3.
Figure 5:
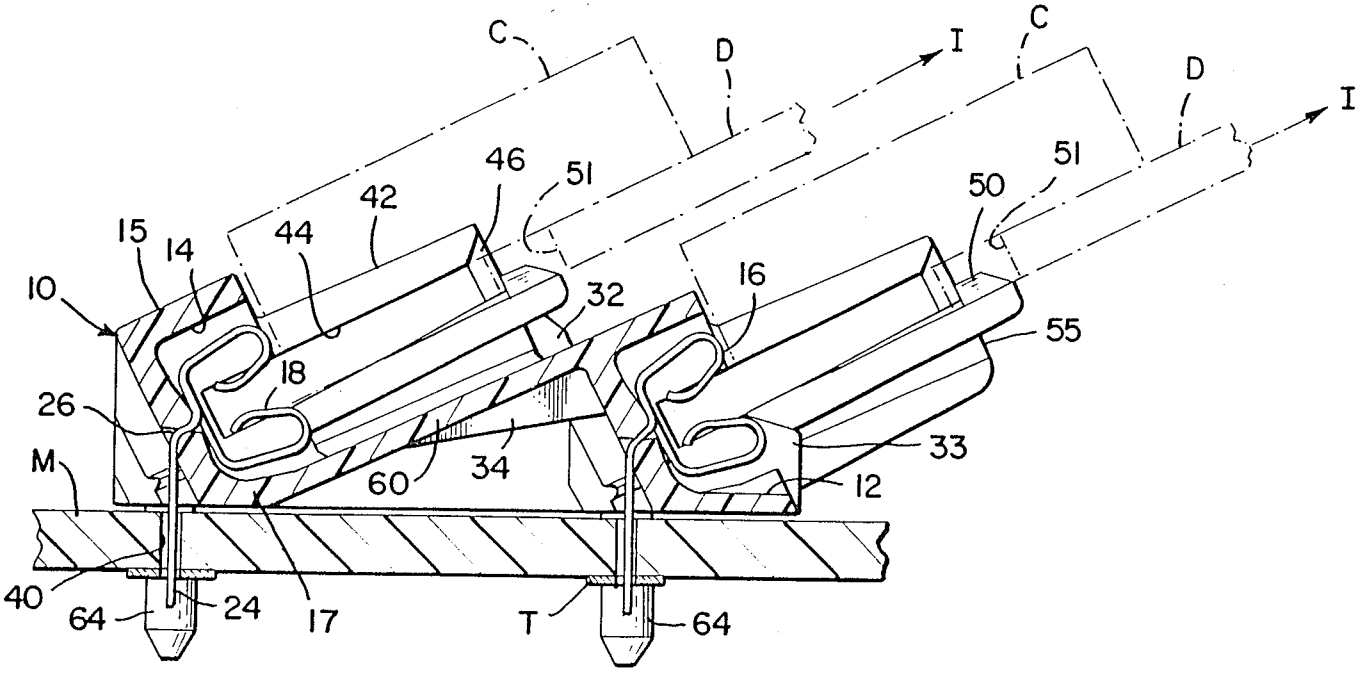
FIG. 5 is an end view of a section of the connector shown in FIGS. 3 and 4.
Figure 6:
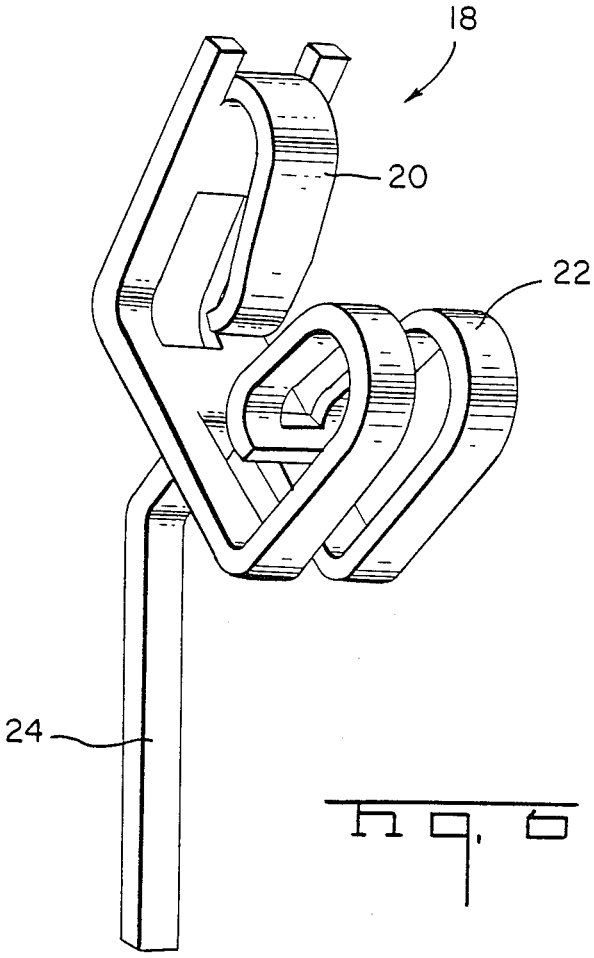
FIG. 6 is an isometric view of the contact shown in the connector of the invention.

Referring now to FIGS. 3–5, the housing of the invention heretofore referred to as H is shown in detail to be a one-piece element 10 having a first row shown as 12 and spaced thereform, a second row 14. These rows contain a series of electrical contacts 16 and 18 mounted within the housing walls. The profile of the contacts can best be seen from FIGS. 5 and 6 to include as is shown with respect to contact 18 in FIG. 6 an upper spring element 20 and a lower bifurcated spring element 22, oriented to contact and bear against the upper and lower surfaces of a memory module inserted therebetween. A memory module D is shown in phantom in FIG. 5, consistent with the showing in FIGS. 2*a* and 2*b*.

The contacts such as 18 have a tail shown as 24 which in one embodiment extends through an aperture 26 in housing 10 as is shown in FIG. 5 to be inserted into the hole in a mother board, such hole being shown as 40 and eventually, soldered to the conductive traces on the surfaces or within the mother board M. As can be seen from FIGS. 3 and 5, the contacts are held in an orientation which is common to a given row and to the axis of insertion shown as I as heretofore mentioned. Details of the contacts such as 18 are covered in U.S. patent application Ser. No. 800,181 filed Nov. 11, 1985 in the name of Roger L. Thrush and assigned to the assignee of the present invention, the substance of that disclosure being incorporated herein by reference. Reference is made to such application for additional details relative to a preferred embodiment of contact, it being understood that contacts having the same function but of different geometries are contemplated. The critical aspects of the contact relate to the fact that the U-shaped elements 20 and 22 have sufficient spring characteristics to provide adequate normal forces for effective contact with the pads on the memory module D without being overstressed or permanently deformed in normal use. Additionally, it is important that the interior surfaces of the elements 20 and 22 be given a surface finish appropriate to the particular spring design and the particular duty, including numbers of insertions and environment of both inventory and use contemplated. Similarly, the surface of the post 24 should be coated or plated or otherwise made compatible with the particular process of interconnection to the mother board circuit paths as by wave soldering, flow soldering, or other such processes.

It is to be realized that the contacts such as 18 and accordingly the housing chambers for the rows 12 and 14 are in practice quite small, the row cavities being typically on centers of 0.1 inches, which makes the various dimensions, thicknesses, wall sections and the like, quite small and relatively fragile. The nature of these parameters emphasizes the need for providing adequate board and contact support.

As part of the strengthening of the contact housing 10, the individual cavities for the contacts are defined by wall sections 30 (FIGS. 3 and 5) and extend along the sides of the contacts 18, the wall sections being integrally molded with upper and lower plastic portions shown as 15 and 17, respectively, in FIG. 5. Additionally, ramparts shown in FIG. 4 as 32 are brought out of the vertical wall sections 30 periodically toward the center area of the housing 10, and as shown in FIG. 5, ramparts 34 are included on the opposite side of a web 60. The ramparts 32 serve the function of strengthening and guiding the memory module during insertion in the event that there is some bow or sag in the center thereof. As shown in FIGS. 3 and 5, similar guiding structures 33, also termed ramparts, are located with respect to the row 12 in FIGS. 3 and 5.

As can be seen best in FIG. 5, the contacts such as 18 are anchored within the cavities associated with their respective rows by virtue of the tab or post elements 24 being inserted through the rear wall aperture 26 and then deformed downwardly in the position as shown. This serves to snug the contacts into position and hold them there, centered properly relative to insertion of the memory modules.

As can best be seen in FIG. 3, there is included at either end of the rows 12 and 14 a strengthening and guiding structure shown as 42 which includes interiorly thereof, a groove 44 which serves as a PC board guide and support element, catching the edges of a PC board and thus centering the board relative to its pads with the contacts 16, 18 in a given row. As will be observed from FIG. 4, a printed circuit board is shown in phantom inserted in the upper row 14 of the connector housing 10. At the leading edge of the groove 44 are beveled face portions shown as 46 which help guide the insertion of a printed circuit board. Also shown in FIG. 3 is a latch structure 48 formed integrally from the molding of the housing which is beveled and has a projection at 50 intended to fit within the hole 51 of a printed circuit board to latch such board into position in the housing. This detail is shown in FIG. 2B and in phantom in FIG. 5. Directly in alignment with the latch structure 48 is an aperture shown as 52 in FIG. 3, which extends through the housing sidewall allowing the latch structure to be molded by a straight action closure of the molding surfaces, apertures 52 defined by retracting pin portions of the mold which are initially inserted through the housing to define the rear surface of 50. The element 54 is intended to show the relatively thick portion of the end guiding projection 42 which provides structural support for the memory module.

The housing 10 includes at each end of each row a similar structure to that just described with respect to 42, essentially reversed on the left side of the connector and modified on the lower part of the connector as at 55 for the purpose of establishing vertical surfaces shown as 57 for automatic handling as by robotic fingers. The surfaces need precise definition, and need to be flash and sprue free.

In use, the end structure such as 42 functions to guide, position and latch a printed circuit board into position within the rows 12 and 14. U.S. patent application Ser. No. 800,181 as aforementioned shows these features in greater detail. To remove a board from the connector, it is necessary to depress the latches as at 50 so that the projection surfaces clear the edge of the holes in the board and the board can be withdrawn. As will be discerned from FIG. 5, the plane of axis I is at an angle of roughly 25 degrees from the plane of the mother board M. This angle and therefore the axis of withdrawal, may be varied in accordance with packaging needs but suffice to say, it is different from and substantially less than the normal 90 degree angle of intersection of the planes of memory modules and mother boards.

Housing 10 includes as a further detail, four posts 64 which are inserted through holes in the mother board to position the connector housing initially prior to soldering of the tabs 24 thereto. The projections 64 may be optionally of different diameters to match different diameters in the mother board so as to polarize or orient the mounting of the housing in such board. Also optionally, after insertion of the housing 10 and the terminal post 24 through holes in the mother board, the posts 64 may be deformed by heat and/or pressure to mechanically lock the housing 10 to the mother board, the intention being to reduce the strains placed on the solder joints between the tabs 24 and the circuit traces of the mother board, the posts partially accommodating such mechanical strains during insertion, withdrawal of memory modules and during the life of the electronic package served by the connector.

In accordance with the invention, the two connector rows 12 and 14 are interconnected by a web 60 shown in FIGS. 3, 4 and 5, which in conjunction with the ramparts heretofore described and the end elements of 42 and 62, create a structure of considerable strength and integrity, tying all of the various elements of housing 10 together in one homogeneous mass of plastic material. As heretofore mentioned, the ability of the connector housing to support memory modules at an angle relative to the mother board, is enhanced by the particular structure embraced by the invention.

As a further aspect of the invention, reference is now made to FIG. 3 and to a series of arrows labeled MP which refer to mold parting axes. Three such axes are shown, one axis labeled MP1 coming off the face of the connector parallel to the axis of board insertion I, a second axis labeled MP2 parallel to MP1 but in an opposite direction and coming off the rear face of the connector, and finally, a third axis labeled MP3 parallel with the mounting surface of the connector and with the posts 64. Shown in FIG. 3 is a further axis labeled PI which is the axis of plastic injection during molding, there being dotted in and labeled F, plastic flow lines indicative of the flow of plastic during an injection cycle. The connector housing 10 is molded in one cycle as one integral mass of plastic and it has been discovered that the cavity which forms the structure of web 60 by being made continuous and utilized as an internal sprue for accommodating the flow of plastic, allows a fill of the details of the housing without knit lines or voids in mold filling. Put another way, holes or apertures or other reliefs in 60 for whatever purpose that might impede such flow, have been found to cause molding complexities including longer cycle times and improper fill, not only adjacent to such discontinuities, but in fine details such as the ramparts and/or the walls such as 30 as shown in FIG. 3.

In practice, the interior surfaces of the molds, which can be discerned from an examination of FIGS. 3, 4 and 5, are closed to form a volume of the shape indicated with injection being made at one end as at the point where the arrow of PI is disposed in FIG. 3, and in FIG. 4, plastic under high pressure is injected to fill the cavity of the mold, a suitable dwell time is allowed and then the mold is opened with the first draw axis being along the directions indicated by the arrows MP1 and MP2 parallel to I; that part of the mold accommodating the undersurface and posts 64, thereafter being drawn open along axis MP3 to release the housing from the mold. Ejection of the part takes place by lifters which bear against the surfaces L as shown in FIG. 3, along the length of the connector housing. In practice, it is contemplated that without posts 64 a straight action may be used, as where rivet holes and brackets are employed. It should be noted that the molding techniques as disclosed above allows the web 60 and the latches 48 to be integrally molded within the unitary structure which defines the connector housing. As the mold parting lines are oblique parting lines parallel to the axis of the cavities, rather than perfectly perpendicular or horizontal part lines, the integral web can be formed by the passing mold dies which in conjunction with each other, form the rear wall 70 of the first row 12 and the internal contact receiving surface 72 of the second row 14, as best shown in FIG. 5. As mentioned earlier the availability of the latching structure of surface 50 is defined by retracting pins which also define apertures 52 (FIG. 3) during their retraction.

In an actual example of the invention in a preferred embodiment, the material for the housing 10 was comprised of a glass fiber reinforced thermoplastic liquid crystal polymer, of which a number are available as engineering materials from a variety of common sources. The contacts such as 18 were made of stamped and formed beryllium copper of a thickness on the order of less than 0.01 inches, having postplated gold surfaces selectively applied to the upper portions of the contacts, and having a tin leaded solder plated onto the posts 24, there being a suitable nickel underplate over the surface of the contact 18. Relative to the illustrative embodiment, the contacts were centered on 0.1 inch centers to be inserted in the holes in the memory modules which were on the order of 0.04 inches. To give an idea of size, the posts 64 were on centers of 0.5 inches relative to FIG. 5 and the length of the connector housing 10 from end to end was on the order of 3.8 inches. The ends of the latches were intended to fit within holes in the memory module approximately 0.125 inches in diameter and the contacts themselves were intended to mate with pads roughly 0.07 inches in width and similarly dimensioned in depth, placed on the edge of the memory module. Such boards were on the order of 0.05 inches in thickness.

In the foregoing description, reference has been made to printed circuit boards in the form of memory modules and mother boards which are typically formed of a variety of materials such as phenolics and epoxy. It is fully contemplated by the present invention that the structural aspects are applicable to connectors which accommodate other electronic packages of the type which may be inserted into an edge card type contact including those of a much smaller scaled-down dimension made of glass or ceramic, silica or other materials utilized for displays, memory, logic, and other such applications.

In the use of terminology, the words "board", "card", "module", and "package" have been employed to describe circuit elements which mate and unmate together to form functioning, electronic products. It is pointed out that the choice of terminology employed is consistent with the terminology used in the state of the art to which the invention relates in order to illustrate and exemplify the preferred practice of the invention, but not to restrict its scope; the appended claims being reserved to that end.

We claim:

1. A connector for interconnecting a plurality of planar modules carrying electronic components to a base planar circuit having circuit paths to interconnect said components, including a plastic housing having at least two integrally molded, longitudinally extending rows of cavities, one of the planar modules being receivable into each said row, with the rows being spaced apart transversely of their lengths, at least two sets of contacts, one for each of said rows fitted into said cavities and locked to said housing, guide channels integrally molded with the housing at each end of each said row, each said guide channel including two opposed sidewalls and an endwall to guide and position the edge and surfaces of said planar modules into alignment with said contact row, and further including a base portion mountable to the surface of the base planar circuit, the said rows of cavities, contacts, and guide means defining the said two rows having an axis of insertion of the planar modules at an angle relative to the surface of the base planar circuit appreciably less than 90 degrees, the said rows of said connector and the said guide channels of the two rows are formed into two planar module receivers integrally joined by a web of the plastic material of said housing, the web being defined by upper and lower web surfaces which are essentially parallel to said axis of insertion, said web serving to strength and rigidify the said rows one to another, whereby to provide a lower profile electronic package accommodating the interconnection of planar modules to the said base planar circuit.

2. The connector of claim 1, wherein the said angle is limited to between 20 and 40 degrees.

3. The connector of claim 1 wherein the housing, as part of the guide channels, further includes an integrally formed latch means which is positioned essentially parallel to the insertion axis, for latchably attaching to an aperture in a matable module, when the module is fully inserted.

4. The connector of claim 3 wherein the guide channels is profiled for straight insertion of the module and the latch means is resiliently biased for deflecting during the insertion thereof and returning to an undeflected position when in the latched position.

5. In a connector for interconnecting a plurality of memory modules to a common circuit mother board, a plastic and insulating housing comprises at least two longitudinally extending rows of cavities, one of the planar modules being receivable into each said row along an axis of insertion, with the rows being spaced apart transversely of their lengths, the said rows of said connector being formed into two planar module receivers integrally joined by a web of the plastic material of said housing which is essentially parallel to said axes of insertion, said web serving to strengthen and rigidify the said rows one to another, sets of contacts contained in said rows having pad contacting elements oriented to engage the pads of memory modules inserted into said rows along the insertion axis, said housing further including at the end of each row thereof memory module guide and support means for aligning each planar module with a contact row, the said housing having a base adapted to be positioned on and parallel to the surface of a mother board with the plastic material of the said rows and guide means being formed so that the said axis of insertion of a memory module is at an angle relative to the surface of said mother board substantially less than 90 degrees, whereby to provide a low profile electronic package.

6. The connector of claim 5, wherein the said web is essentially solid from end to end and across its breadth, whereby to facilitate flow of plastic during the molding of said connector.

7. The connector of claim 6, wherein the surfaces of said housing are positioned to allow a straight draw action of the mold of which the said housing is formed.

8. The connector of claim 7, wherein the said housing is formed by plastic material injected at one end thereof and caused to initially flow in and along the volume defined by said web.

9. A connector molded in one piece to include a plastic housing having at least two longitudinally extending rows of cavities, one of the planar modules being receivable into each said row, with the rows being spaced apart transversely of their lengths, the cavities defining contact receiving means and contacts inserted therein and locked to said connector by tab means inserted through apertures in the rear of said cavities, said contacts having spring elements aligned to receive the insertion of modular planar printed circuit boards along a given axis for contact therewith, said tab means being aligned and deformed to be oriented at an angle less than 180° and greater than 90° relative to said given axis to be inserted into an aperture of a further planar printed circuit board, the said rows being connected together along the length by a web of plastic which extends substantially parallel with the given axis and essentially solid throughout for ease of plastic flow during molding, guide means at each end of each row for guiding and supporting said planar modular boards, said rows and guide means being integrally one piece with said web to provide structural integrity, said rows, guide means and web being oriented to support said modular planar boards in a plane at an angle substantially less than 90 degrees relative to the plane of the said further planar board.

10. An electrical connector which is mountable to a base planar circuit board, for interconnecting planar modules to the base planar circuit board comprises:

an insulative housing means including at least two longitudinally extending rows of terminal receiving cavities spaced apart transversely of their length, the two rows of cavities forming first and second insertion axes parallel to a given axis which is less than 90° relative to the base planar circuit board when the connector is mounted thereon, the two rows of cavities being interconnected by an integral structural web which extends along the given axis, the cavities being profiled for receipt of the planar modules inserted along the insertion axes and into the cavities; and a plurality of terminals including opposed contact portions placed in side-by-side alignment within the cavities spaced for registration with traces on the planar modules, and a printed circuit portion extending below a base of said housing means for contact with the printed circuit board.

11. The electrical connector of claim 10 wherein the first insertion axis is above the given axis and the second insertion axis is below the given axis.

12. The electrical connector of claim 11 wherein the two rows of cavities are formed by first and second longitudinally extending channels, along respective first and second axes, each channel having upper and lower walls which define the cavities for said terminals.

13. The electrical connector of claim 12 wherein the lower wall of said first row is integral and parallel with said web.

14. The electrical connector of claim 13 wherein the upper wall of said second row is integral and parallel with said web.

15. The electrical connector of claim 10 further comprising guide means located at the end of each row extending parallel to said given axis for aligning said planar modules with said cavities.

16. The electrical connector of claim 12 wherein each said contact is formed by two terminal portions adjacent to its upper and lower wall in its respective cavity, and two contact portions inwardly formed to define opposed contact portions tangent to lines parallel with the respective insertion axis.

17. An electrical connector for interconnection of planar memory modules to a planar printed circuit board, the connector comprising:

two module receiving channels defining two longitudinally extending cavities spaced apart transversely of their length, the two channels being parallel to a given axis which is less than 90° relative to the planar circuit board when the connector is mounted thereon, each of the channels including base means for planar mounting on the printed circuit board, the two channels being interconnected by an integrally molded web of insulative material extending between the two channels and along the given axis, the web being substantially solid along the length for ease of plastic flow during molding;

terminal receiving cavities integrally formed within the channels by walls which are spaced along the channels transverse to the length of the channel;

a plurality of electrical terminals mounted within the respective cavities including contact portions tangent to the modules upon insertion of the modules along the insertion axis; and guide means integrally molded with the module receiving channels upstanding from front faces of the module receiving channels, the guide means being centered along respective insertion axes of the respective module receiving channels.

18. The electrical connector of claim 17 wherein each module receiving channel further comprises at least one latch member extending outwardly from the front face of the channel generally parallel to and offset from the given axis to allow insertion of the memory modules, the latch members including a latching surface which faces inwardly towards respective channels, the latching surface having an angle relative to the printed circuit board which is generally a complementary angle with the given axis, whereby the latching member is latchable with an aperture which extends through the memory modules, thereby retaining the modules in electrical connection within the connector channels.

* * * * *